United States Patent [19]

Ward et al.

[11] 4,146,357

[45] Mar. 27, 1979

[54] FUEL FIRED BURNERS

[75] Inventors: Trevor Ward; Clive Ward, both of Dewsbury, England

[73] Assignee: Hotwork International Limited, England

[21] Appl. No.: 770,119

[22] Filed: Feb. 18, 1977

Related U.S. Application Data

[63] Continuation of Ser. No. 600,443, Jul. 30, 1975, abandoned.

[51] Int. Cl.[2] ..... F23R 1/00

[52] U.S. Cl. ..... 431/158; 239/DIG. 7; 431/8

[58] Field of Search ..... 431/8, 9, 2, 158, 115, 431/116; 239/DIG. 7

[56] References Cited

U.S. PATENT DOCUMENTS

| | | | |
|---|---|---|---|
| 2,052,869 | 9/1936 | Coanda | 239/DIG. 7 |
| 3,729,286 | 4/1973 | Iida | 431/158 |

FOREIGN PATENT DOCUMENTS

| | | | |
|---|---|---|---|
| 154674 | 1/1954 | Australia | 239/DIG. 7 |

*Primary Examiner*—Edward G. Favors

*Attorney, Agent, or Firm*—Wolf, Greenfield & Sacks

[57] ABSTRACT

A method of and means for changing the direction of flow of the products of combustion leaving a fuel fired burner. Located adjacent to the discharge end of a combustion chamber of the burner is a quarl or burner block having a convex surface defining a deflection path which follows closely said surface and along which the projected combustion products are caused to flow under the influence of surrounding gaseous pressures. The passage through the quarl in advance of the convex surface is restricted, for example by an encroachment of the convex surface into the passage and a deflector lip projecting into the passage opposite to said encroachment. The quarl may be inserted in the wall of a furnace at right angles thereto and without projecting therebeyond to direct the combustion products along the wall surface.

1 Claim, 3 Drawing Figures

FUEL FIRED BURNERS

This is a continuation of application Ser. No. 600,443, filed July 30, 1975, now abandoned.

This invention relates to fuel fired burners whether using gaseous, liquid or solid fuel, and has for its object to provide an improved method of and means for changing the direction of flow of the products of combustion leaving the burner.

Normally these burners, when used for heat-treatment purposes such as heating furnaces in which large objects or fabrications are placed, are located so that the products of combustion are projected into the furnace in the same direction as that of the flow of the burning gases through the combustion chamber of the burner. If for any particular reason connected with specific circumstances or conditions or requirements of a heat treatment process the direction of flow of the products of combustion leaving the burner has to be changed, deflector plates or like devices have heretofore had to be used, but the impingement on these devices of the hot gases causes rapid deterioration of the devices. Also these deflector plates or the like project beyond the furnace wall inwardly and thereby may offer obstruction to the insertion into the furnace or large objects or fabrications to be heat treated.

According to this invention therefore there is provided a method of changing the direction of flow of the products of combustion leaving a fuel fired burner, which comprises locating adjacent to the discharge end of the combustion chamber of the burner a quarl or burner block having a convex surface defining a deflection path which follows closely said surface and along which the projected products of combustion are caused to flow under the influence of surrounding gaseous pressures.

It is to be understood that the said convex surface is located beyond the discharge opening of the burner so as not to be opposed by any adjacent surface so that the flow of the combustion products along said deflection path is not caused by any structural deflecting feature but by the controlled influence of surrounding gaseous pressures.

In order to carry out the above method there is also provided according to the invention a quarl or burner block having a passage with an inlet portion to receive the products of combustion from the combustion chamber of a fuel fired burner, a discharge portion forming a restricted outlet from said passage and beyond said outlet a convex surface defining said deflection path and unopposed by any adjacent surface.

The quarl or burner block may constitute a duct extension of the discharge end of the combustion chamber of the burner.

The beginning of the convex surface cooperates with an inwardly projecting deflector lip on the opposite side of the discharge portion to constitute said restricted outlet.

Also the convex surface follows in the direction of flow substantially the arc of a circle, although some other curvature may be effective in some circumstances.

The inner profile of the quarl or burner block at and adjacent its discharge portion may be calculated taking into account the discharge velocity from the burner, the desired angle of change in direction and other factors present in any particular case of application of the invention.

The invention will now be described more fully with reference to the accompanying drawings wherein.

Figure 1:
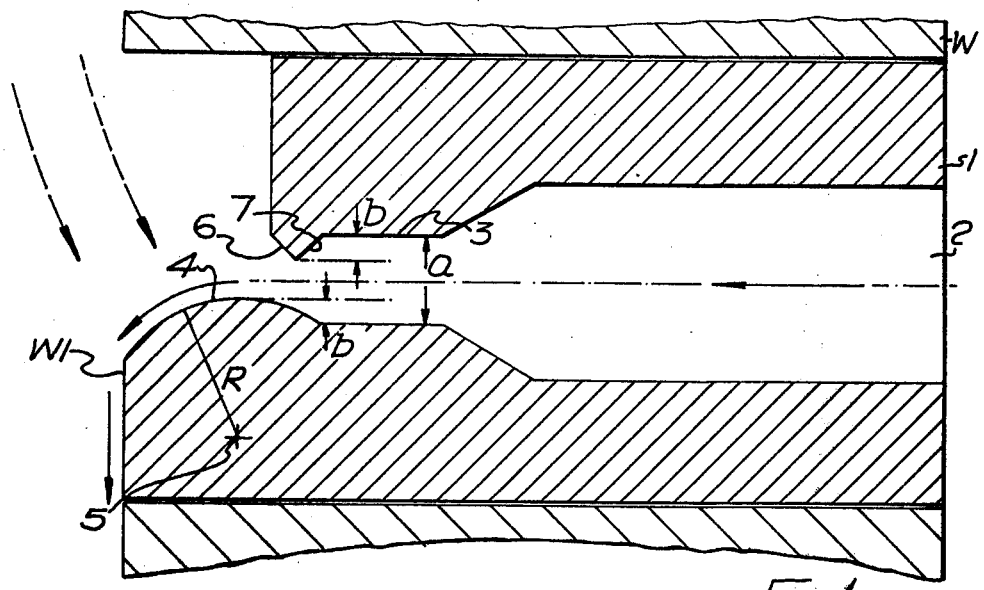
FIG. 1 illustrates b way of example in longitudinal cross-section one form of quarl (as it will hereinafter be termed) according to the invention and located in a furnace wall.

Referring to FIG. 1 of the accompanying drawings, there is shown inserted in the wall W of a furnace at right angles thereto a quarl 1. This will be made from a suitable refractory material and will be connected to or aligned with the discharge end (not shown) of the combustion chamber of a burner. The whole central passage through the quarl may be of circular cross-section, but for the purpose of this example it will be assumed that the discharge portion and the convex surface will have their dimensions at right angles to the plane of the paper in FIG. 1 larger than those shown in the plane of the paper so as to produce an elongated or slot-like discharge outlet.

The main central passage 2 is reduced at 3 to a dimension a which is chosen according to the burner discharge volume in accordance with normal burner design practice. A still further restricted outlet is produced by forming on one side thereof a convex surface 4 having a radius R formed about a centre 5 such that the surface commences from portion 3 by encroaching on the central passage but then leads away from the passage and terminates substantially in line with the inner surface W1 of the furnace wall. On the other side of the outlet a deflector lip 6 also encroaches on the central passage opposite to the encroaching part of the convex surface 4, the rear face 7 of the lip being inclined inwardly and forwardly (that is, in the direction of flow of the combustion products) to urge these products against the convex surrace.

This construction is so designed that the products of combustion (indicated by full-line arrows) are directed towards the convex surface 4 and that the restriction between that surface and the lip 6 produces an injector effect which entrains some of the furnace atmosphere (indicated by broken-line arrows). This entrained atmosphere pressurises the flow of combustion products over the convex surface 4 as compared with the lower pressure on the underside or inner side of the flow, thus ensuring that the flow follow the surface 4 and is thereby deflected though approximately 90° into its new direction.

It has been found that the invention operates with a wide range of burner discharge velocities and angles of flow deflection. For normal discharge velocities emanating from a tunnel burner of usual construction, the dimension a will determine the radius R, and the encroachments on the central passage of the surface 4 and the lip 6 will each have the same dimension b which will be substantially one quarter of dimension a.

Figure 2:
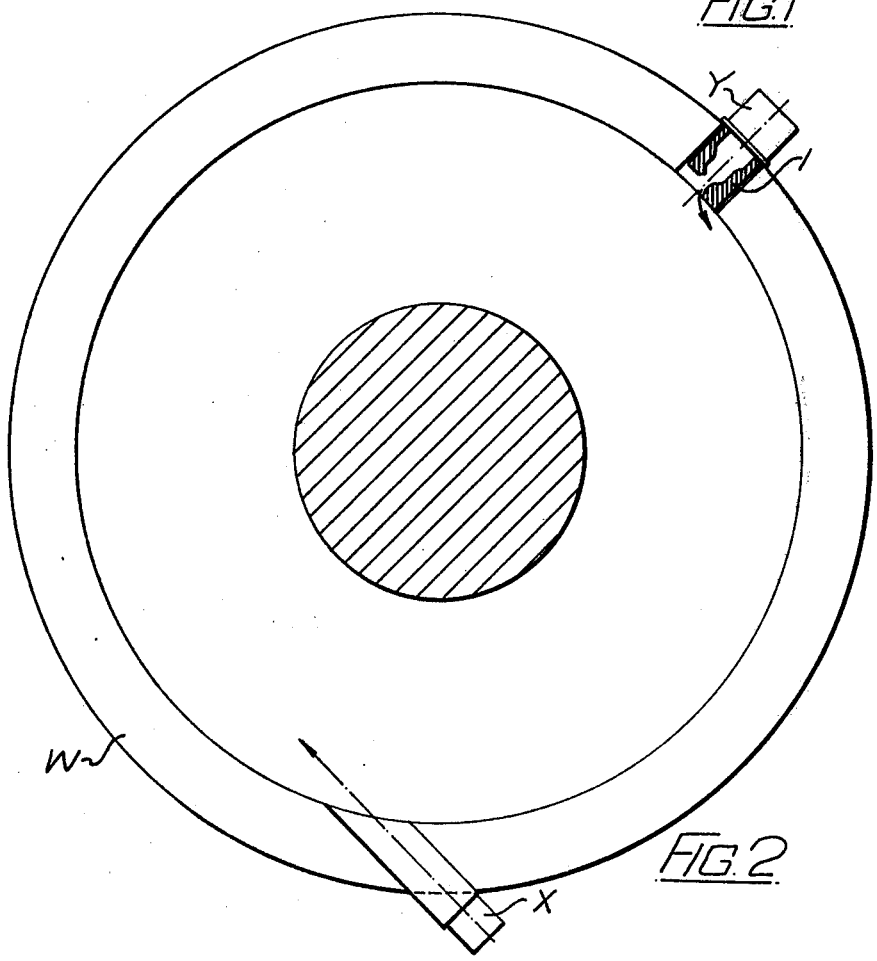
FIG. 2 illustrates schematically the orthodox method of inserting a burner in a circular furnace wall and also the method according to the invention.

One useful application of the invention is shown in FIG. 2 for heating a circular furnace. X indicates how a burner is normally inserted in the furnace wall W to cause a circulatory motion. In the furnace, the burner having to be mounted on the skew and often requiring special support fittings and extension members. Instead, a burner Y including a quarl 1 is shown inserted at right angles in the wall, so as to direct the hot gases along the wall.

Figure 3:
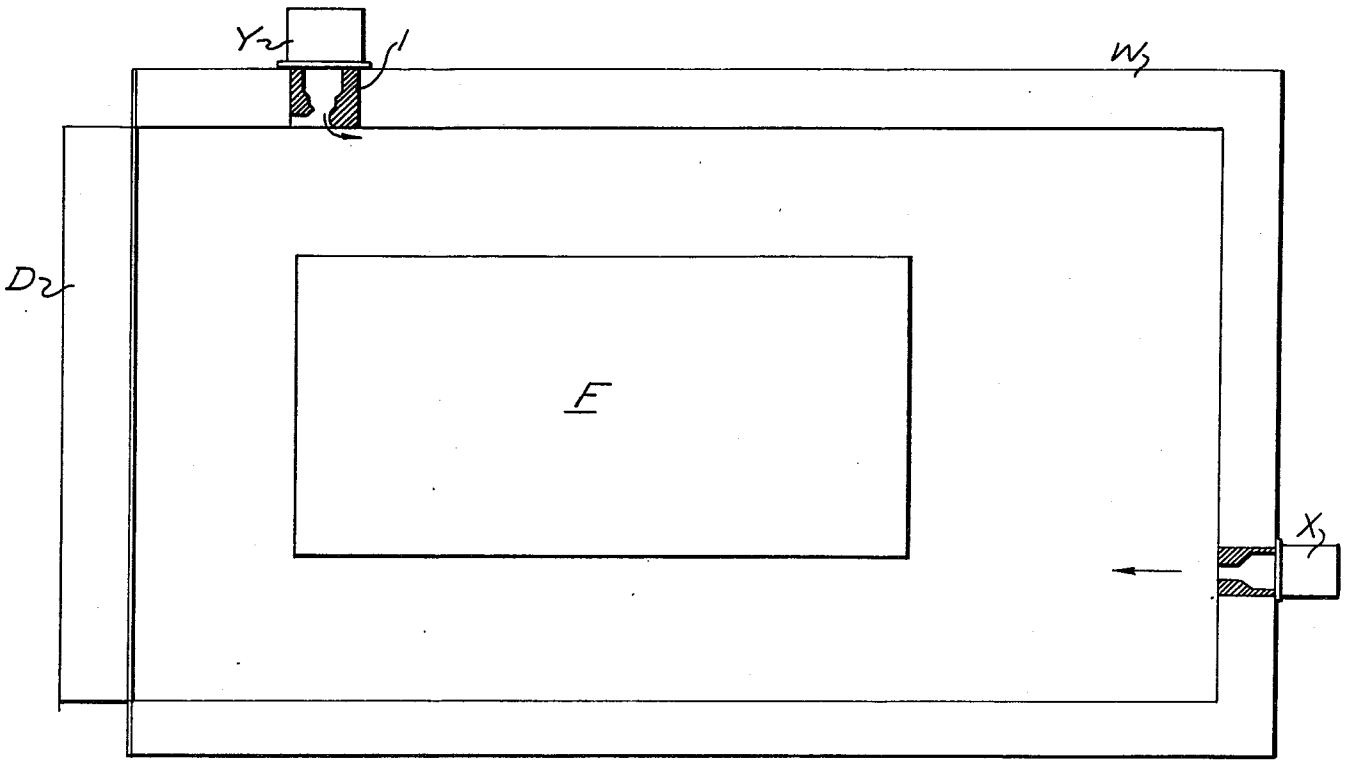
FIG. 3 illustrates schematically the application of the invention to a large furnace where it is not practicable to insert a burner through an end wall.

Another very useful application of the invention is shown in FIG. 3 where a burner is required to project its products of combustion longitudinally into a heat treatment furnace along a wall W thereof, but where a large end loading door D for passage of a large fabrication F necessitates introducing a burner through a side wall of the furnace, usually at right angles there to. One burner X can be inserted as usual in the fixed end wall, adjacent one side wall, and a burner Y with quarl 1 is shown inserted in the other side wall adjacent to the door so as to direct the hot gases along that wall. This is done without projecting structurally into the furnace space, whereas, previously in such circumstances the burner has been set in the wall on the skew and cone or cranked extension pipe has projected into the furnace space to direct the gases along the wall, thereby taking up valuable space and being subject to rapid burning.

Another useful application of the invention is for insertion of a burner through the roof of a "beehive" kiln to direct the burner gases along the underside of the roof. A further useful application is for insertion of a burner in the wall of a vertical furnace to direct the burner gases down the wall so as to pass beneath an object or fabrication to be heat treated.

We claim:

1. A device for changing the direction of flow of the products of combustion leaving a fuel fired burner, the device comprising a refractory body having a passage whose inlet is arranged to receive the products of combustion of the fuel fired burner, the outlet of the passage having a restricted opening through which the products of combustion exit in a stream, the refractory body having a curved surface located wholly on one side of the passage, the curved surface being convex and having a portion of the surface protruding into the restricted opening to further restrict that passage at its outlet, the curved surface having a further portion extending rearwardly of the outlet of the passage, a deflector lip on the other side of the passage protruding toward the curved surface and forming therewith the aforesaid further restriction at the outlet of the passage, the deflector lip having an inclined face in the restricted passage which inclines forwardly toward the outlet of the passage and inwardly toward the curved surface, and the curved surface beyond the lip being free of any adjacent opposed surface whereby the exiting stream follows the contour of the curved surface.

* * * * *